US006340398B1

(12) United States Patent
Parthasarathy et al.

(10) Patent No.: US 6,340,398 B1
(45) Date of Patent: Jan. 22, 2002

(54) OXIDATION PROTECTIVE COATING FOR MO-SI-B ALLOYS

(75) Inventors: Triplicane A. Parthasarathy; Madan G. Mendiratta, both of Beavercreek; Dennis M. Dimiduk, Bellbrook, all of OH (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 09/542,788

(22) Filed: Apr. 4, 2000

(51) Int. Cl.[7] ..... C23C 8/60

(52) U.S. Cl. ..... 148/279; 148/281; 427/252; 427/255.17; 427/255.18

(58) Field of Search ..... 148/279, 281; 427/252, 255.17, 255.18

(56) References Cited

U.S. PATENT DOCUMENTS 2,711,973 A * 6/1955 Wainer et al. ..... 148/279
3,090,702 A * 5/1963 Commanday et al. ..... 427/201
3,764,397 A * 10/1973 Bornstein et al. ..... 148/279
4,822,642 A 4/1989 Cabrera et al.
5,437,744 A 8/1995 Carlen
5,595,616 A 1/1997 Berczik
5,693,156 A 12/1997 Berczik
5,865,909 A 2/1999 Meyer et al.

FOREIGN PATENT DOCUMENTS

GB 1 529 441 * 10/1978

* cited by examiner

*Primary Examiner*—John Sheehan
*Assistant Examiner*—Andrew L. Oltmans
(74) *Attorney, Agent, or Firm*—Charles E. Bricker; Thomas L. Kundert

(57) ABSTRACT

A method for enhancing the oxidation resistance of substrates fabricated from metallic molybdenum and alloys containing at least 50% molybdenum which comprises depositing silicon on the surface of the substrate under conditions which cause the formation of an outer layer of $MoSi_2$. Also disclosed is a method for enhancing the oxidation resistance of other substrates, such as carbon-carbon and metals and alloys which show minimal reaction with molybdenum under the coating conditions, which comprises depositing a layer of molybdenum on the surface, then depositing silicon on the molybdenum layer under conditions which cause the formation of an outer layer of $MoSi_2$.

1 Claim, No Drawings

OXIDATION PROTECTIVE COATING FOR MO-SI-B ALLOYS

RIGHTS OF THE GOVERNMENT

The invention described herein may be manufactured and used by or for the Government of the United States for all governmental purposes without the payment of any royalty.

BACKGROUND OF THE INVENTION

The present invention relates to molybdenum alloys that have been made oxidation resistant by the addition of silicon and boron.

Molybdenum metal is an attractive material for use in jet engines and other high temperature applications because it exhibits excellent strength at high temperature. In practice, however, the utility of molybdenum has been limited by its susceptibility to oxidation. When molybdenum or molybdenum alloys are exposed to oxygen at temperatures in excess of about 1000° F. (538° C.), the molybdenum is oxidized to molybdenum trioxide and vaporized from the surface; resulting in shrinkage and eventually disintegration of the molybdenum or molybdenum alloy article. Most previously disclosed methods of preventing oxidation of molybdenum at high temperature in oxidizing environments (such as air) have required a coating to be applied to the molybdenum alloy. Applied coatings are sometimes undesirable due to factors such as: poor adhesion, the need for extra manufacturing steps, and cost. Furthermore, damage to the coating can result in rapid oxidation of the underlying molybdenum alloy.

Berczik, U.S. Pat. No. 5,595,616, discloses molybdenum alloys containing up to about 4.5 weight % silicon and up to about 4.0 weight % boron. When these alloys are exposed to an oxidizing environment at temperatures greater than 1000° F., the material will produce a volatile molybdenum oxide in the same manner as conventional molybdenum alloys. Unlike conventional alloys, however, oxidation of these alloys produces build-up of a borosilicate layer at the metal surface that will eventually shut off the bulk flow of oxygen. After a borosilicate layer is built up, oxidation is controlled by diffusion of oxygen through the borosilicate and will, therefore, proceed at a much slower rate.

Although these alloys have improved oxidation resistance, as compared to molybdenum metal, they are still not sufficient for use in several applications. The alloys are known to intrinsically form a borosilicate scale at high temperatures. While their oxidation resistance may be marginally acceptable at 1300° C., they have very poor oxidation resistance at 800° C. and lower temperatures, exhibiting rapid weight loss.

Accordingly, it is an object of the present invention to provide a method for improving the high temperature properties of metallic molybdenum and alloys containing at least 50% molybdenum.

It is another object of the present invention to provide a method for improving the high temperature properties of metals and their alloys, which metals and alloys exhibit minimal reaction with molybdenum.

Other objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

SUMMARY OF THE INVENTION

In accordance with the present invention there is provided a method for enhancing the oxidation resistance of substrates fabricated from metallic molybdenum and alloys containing at least 50% molybdenum which comprises depositing silicon on the surface of the substrate under conditions which cause the formation of an outer layer of $MoSi_2$.

Also provided in accordance with the present invention is a method for enhancing the oxidation resistance of other substrates, such as carbon-carbon and metals and alloys which show minimal reaction with molybdenum under the coating conditions, which comprises depositing a layer of molybdenum on the surface, then depositing silicon on the molybdenum layer under conditions which cause the formation of an outer layer of $MoSi_2$.

DETAILED DESCRIPTION OF THE INVENTION

The present invention is a method for enhancing the oxidation resistance of substrates fabricated from metallic molybdenum and alloys containing at least 50% molybdenum which comprises depositing silicon on the surface of the substrate under conditions which cause the formation of an outer layer of $MoSi_2$. The oxidation resistance of such substrates can be enhanced by placing the substrate, together with silicon powder and a suitable catalyst, such as ammonium chloride or hydrazine chloride, in a container, evacuating the container and heating the evacuated container to an elevated temperature for a suitable time. A number of processes are known and available for producing a silicon-rich coating. These processes include, among others:

1. Molten metal or salt baths;

2. Pack cementation which transfers silicon to the substrate by generating a volatile silicon compound in-situ by reaction between pack solids and a gas;

3. Surry/sinter, by which a slurry of silicon-containing powder is applied to a substrate, dried and sintered to produce a silicon coating.

Regardless of the process used, it is important that the substrate be heated, after or during deposition of the silicon, to a temperature of about 800° to 900° C., for example, for a time sufficient to allow the molybdenum and silicon to react and form an outer layer of $MoSi_2$, for example, 2 to 20 hours.

Alloys of molybdenum which may be used in the practice of this invention include alloys containing 0 to 12 atomic percent boron and 0 to 67 atomic percent silicon, such as Mo-11Si-9B, alloys containing 11 to 50 weight percent rhenium, such as Mo-47Re, and the like.

Other refractory alloys may also be used in the practice of this invention including alloys of niobium, rhenium, hafnium and tungsten, containing 0 to 12 atomic percent boron and 0 to 67 atomic percent silicon. In the case of these alloys, the outer layer will be the metal silicide.

Other substrates, such as carbon-carbon and metals and alloys which do not react with molybdenum, can also be provided with enhanced oxidation resistance by depositing a layer of molybdenum on the surface, then depositing silicon on the molybdenum layer under conditions which cause the formation of an outer layer of $MoSi_2$. The other metals include, for example, copper and nickel and their respective alloys. Deposition of the molybdenum on the substrate surface can be accomplished by known methods.

The following example illustrates the invention:

EXAMPLE

A coupon, about 5 mm cube, of an alloy of composition Mo-11Si-9B was heat treated for homogenization at 1550° C. for 100 hours, then 1400° C. for 100 hours in argon. The coupon was then encapsulated in an evacuated quartz tube (approx. 10 cc, by volume) along with 1 g Si powder and 20 mg ammonium chloride and annealed at 850° C. for 10 hours. This resulted in a coating that was predominantly $MoSi_2$. The coated coupon and an uncoated coupon were subjected to repeated thermal cycling (about 50 times) at 800° C. and at 1300° C. The coated coupon survived this cycling and had no detectable mass change for up to 400 hours, while the uncoated coupon suffered rapid weight loss of more than 20% at 800° C. and an additional 10% at 1300° C.

Having thus described exemplary embodiments of the present invention, it should be noted by those skilled in the art that the disclosures herein are exemplary only and that alternatives, adaptations and modifications may be made within the scope of the present invention.

We claim:

1. A method for enhancing the oxidation resistance of substrates fabricated from carbon-carbon and metals and alloys which have a minimal reaction with molybdenum, which comprises depositing a layer of molybdenum on the surface, then depositing silicon on the molybdenum layer under conditions which cause the formation of an outer layer of $MoSi_2$, wherein said silicon is deposited on said molybdenum layer by placing said substrate with said molybdenum deposit thereon in a container vessel together with silicon powder and a catalyst, evacuating said vessel, and heating the resulting assembly to a temperature of about 800° to 900° C. for about 2 to 20 hours.

* * * * *